United States Patent [19]

Irie et al.

[11] 4,394,087

[45] Jul. 19, 1983

[54] MECHANICAL ARRANGEMENT FOR CONTROLLING ELECTROPHOTOGRAPHIC APPARATUS

[75] Inventors: Yutaka Irie, Toyokawa; Kenzo Nagata, Okazaki; Hideo Ito, Toyokawa, all of Japan

[73] Assignee: Minolta Camera Kabushiki Kaisha, Osaka, Japan

[21] Appl. No.: 270,398

[22] Filed: Jun. 4, 1981

[30] Foreign Application Priority Data

Jun. 13, 1980 [JP] Japan ..... 55-80526

[51] Int. Cl.[3] ..... G03G 15/00; G03G 15/04

[52] U.S. Cl. ..... 355/14 E; 355/3 R; 355/14 R; 340/753; 340/712; 340/365 C

[58] Field of Search ..... 355/14 E, 14 C, 14 R, 355/3 R; 340/753, 754, 365 C, 712, 713, 718; 364/518

[56] References Cited

U.S. PATENT DOCUMENTS

| | | | |
|---|---|---|---|
| 3,771,867 | 11/1973 | Moser | 355/14 R |
| 3,787,666 | 1/1974 | Schumann et al. | 364/518 |
| 4,028,531 | 6/1977 | Cottin et al. | 364/518 X |
| 4,149,217 | 4/1979 | Tucker | 340/365 C X |
| 4,204,204 | 5/1980 | Pitstick | 340/365 C X |
| 4,206,336 | 6/1980 | Cunningham | 340/365 C X |
| 4,220,999 | 9/1980 | Reichlin et al. | 340/718 X |
| 4,222,660 | 9/1980 | Furuichi et al. | 355/14 R |
| 4,234,784 | 11/1980 | Totterdell | 340/365 C X |
| 4,242,676 | 12/1980 | Piguet et al. | 340/712 X |
| 4,300,829 | 11/1981 | Braswell et al. | 340/365 C X |

*Primary Examiner*—A. C. Prescott

*Attorney, Agent, or Firm*—Wenderoth, Lind & Ponack

[57] ABSTRACT

An improved mechanical arrangement which includes a controlled device, an operational device for adjusting an active state of the controlled device through external operations and a control device for controlling the active state of the controlled device in response to operations of the operational device.

The operational device includes an indicating arrangement for indicating changes in the active state of the controlled device stepwise, an UP operating arrangement for increasing one step by one step an indication of the indicating arrangement and a DOWN operating arrangement for decreasing one step by one step the indication of the indicating arrangement, and thus the mechanical arrangement has been made free from erroneous operations due to the improved operational efficiency, simple in structure and highly reliable in actual use.

18 Claims, 10 Drawing Figures

MECHANICAL ARRANGEMENT FOR CONTROLLING ELECTROPHOTOGRAPHIC APPARATUS

BACKGROUND OF THE INVENTION

This invention generally relates to a mechanical arrangement and more particularly, to a mechanical arrangement including an operational device for indicating and changing a state of the controlled device adjustable by an operator, e.g., amount of exposure of an electrophotographic copying apparatus.

Generally, in conventional mechanical arrangements, it has been so arranged that a subject or factor controllable by an operator such as exposure amount in an electrophotographic copying machine or the like is adjusted for example by changing a width of a slit with the use of an adjusting lever or by turning or sliding a variable resistor to a suitable extent.

The known arrangements as described above, however, have such disadvantage that, once the lever has been moved from a preset value (e.g., a standard value) for a normal operation to a certain value corresponding to a specific original to be copied, the operator may frequently fail to return the lever to the preset value before reverting to the normal operation, and thus, the copying apparatus is operated with the lever set to the value at the time of the previous operation.

For example, in conventional electrophotographic copying apparatuses, it has been generally arranged that an exposure amount adjusting device is of a lever type and, as is clear from the foregoing description, copying is undesirably performed with the amount of exposure being set to a value selected at the time of the previous copying, which results in improper copying.

Furthermore, in the conventional copying apparatuses, there has been such an inconvenience that, when the amount of exposure is changed from a preset value to a certain value so as to effect interrupt copying during the normal copying mode in which the amount of exposure is set to the preset value and then, the interrupt copying mode is reverted to the normal copying mode, the copying is effected with the amount of exposure set to the value selected for the interrupt copying unless the lever is reset to the preset value manually, which also results in faulty copying.

Moreover, in the conventional electrophotographic copying apparatuses, it has frequently happened that copying is effected, with the amount of exposure for the existing copying left unadjusted, for example, when the power source for the copying apparatus is turned on, when a predetermined number of copy paper has been copied, or when manual paper feeding mode is reverted to automatic paper feeding mode after the latter has been changed over to the former, thus resulting in the similar drawbacks as described above.

As is seen from the foregoing description, known mechanical arrangements have had a number of disadvantages and have presented a problem that an operator's great skill and caution in operation are required to overcome these disadvantages.

SUMMARY OF THE INVENTION

Accordingly, an essential object of the present invention is to provide an improved mechanical arrangement free from erroneous operations so as to improve the operational efficiency.

Another important object of the present invention is to provide an improved mechanical arrangement which is simple in structure and highly reliable in actual use.

In accomplishing these and other objects according to one preferred embodiment of the present invention, there is provided an improved electrophotographic copying apparatus including an operational device for indicating and changing quantity of light of an exposure lamp and a control device for controlling the quantity of light of the exposure lamp in response to operations of the operational device.

In accordance with the present invention, the amount of exposure can be set to an arbitrary value by a push-button operation and can be indicated by a corresponding display lamp, so that check and setting of the amount of exposure is remarkably made easier so as to prevent erroneous copying due to improper setting of the amount of exposure.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the views of the accompanying drawings.

DETAILED DESCRIPTION OF THE INVENTION

Figure 1:
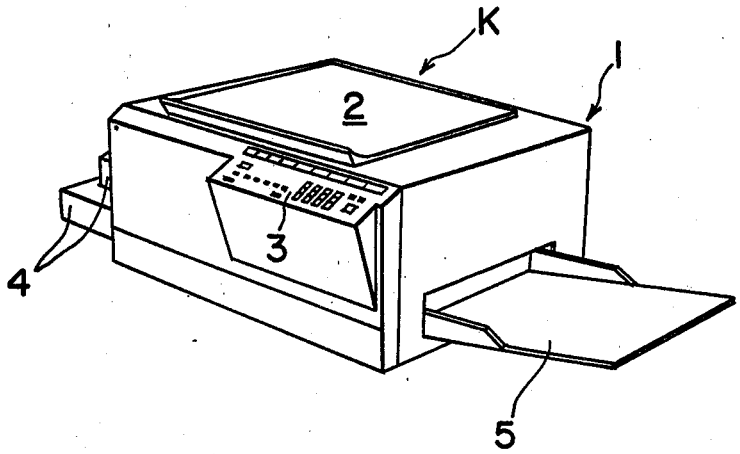
FIG. 1 is a perspective view of an electrophotographic copying apparatus to which the operational arrangement directly related to the present invention may be applied.

Referring now to the drawings, there is shown in FIG. 1 an electrophotographic copying apparatus K to which the operational arrangement of the present invention may be applied.

The copying apparatus K generally comprises a copying apparatus housing 1, an original cover 2 for covering an original to be copied (not shown) placed on an original platform (not shown) provided at an upper portion of the apparatus housing 1, an operating panel 3 provided at a front side wall of the housing 1, paper feeding cassettes 4 disposed at upper and lower portions of a left side wall of the housing 1 and a copy receiving tray 5 provided at a right side wall of said housing 1 as illustrated.

Figure 2:
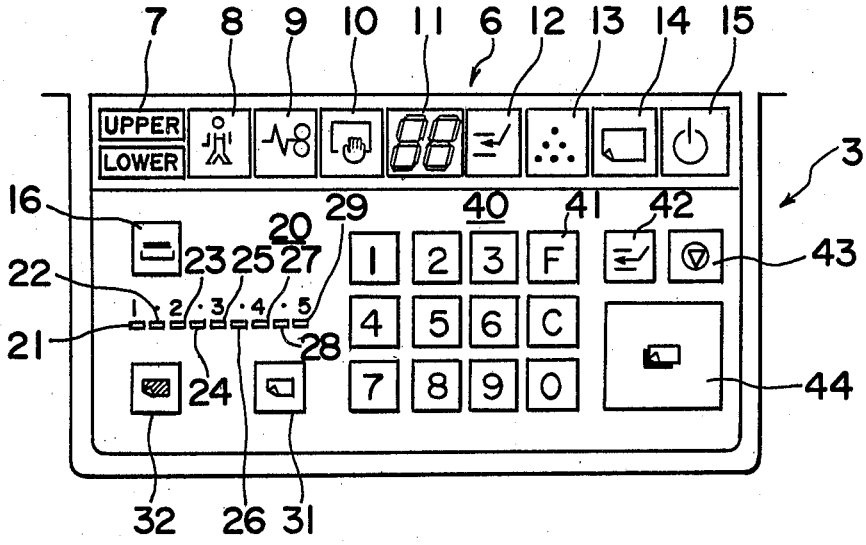
FIG. 2 is a top plan view of an operating panel employed in the electrophotographic copying apparatus of FIG. 1.

As shown in FIG. 2, the operating panel 3 is provided with a copying indicator 6 which indicates states of copying of the copying apparatus K and is formed at an upper portion of the operating panel 3.

The copying indicator 6 further includes cassette indicators 7 for indicating which one of the upper and lower cassettes 4 is in use, a call serviceman indicator 8, a jam indicator 9, a manual paper feeding indicator 10, an indicator 11 for indicating the number of copies to be taken, an interrupt copying indicator 12, an empty toner indicator 13, an empty copy paper indicator 14 and a wait indicator 15, which are so disposed sequentially in this order and in a line from the left side to the right side of the upper portion of the operating panel 3.

Furthermore, the operating panel 3 is provided with a cassette change-over switch 16 which changes over upper and lower cassettes 4 and is formed at one left portion of the operating panel 3 and below the cassette indicator 7, an exposure amount indicator 20 which includes nine display lamps 21, 22, 23, 24, 25, 26, 27, 28 and 29 and is formed below the cassette change-over switch 16, an UP switch 31 and a DOWN switch 32 which adjust the amount of exposure and are formed below the display lamps 21 to 29, ten keys 40 which set the number of copies to be taken and are formed at one central portion of the operating panel 3 and at the right of the UP switch 31 and DOWN switch 32, a function key 41 which causes a specific functioning and is formed at the right of and above ten keys 40, a switch 42 which interrupts normal copying and reinstates the interrupt copying mode to the normal copying mode and is formed at the right of the function key 41, an emergency stop switch 43 formed at the right of the switch 42 and a print switch 44 formed below the emergency switch 43.

The display lamps 21 to 29 show the amount of exposure stepwise in increasing order, so that the display lamps 21 and 29 show the minimum amount of exposure (dark copying) and the maximum amount of exposure (light copying), respectively and the display lamp 25 designates a standard setting value.

The UP switch 31 and DOWN switch 32 are so arranged as to increase and decrease the amount of exposure, respectively.

Figures 3, 4:
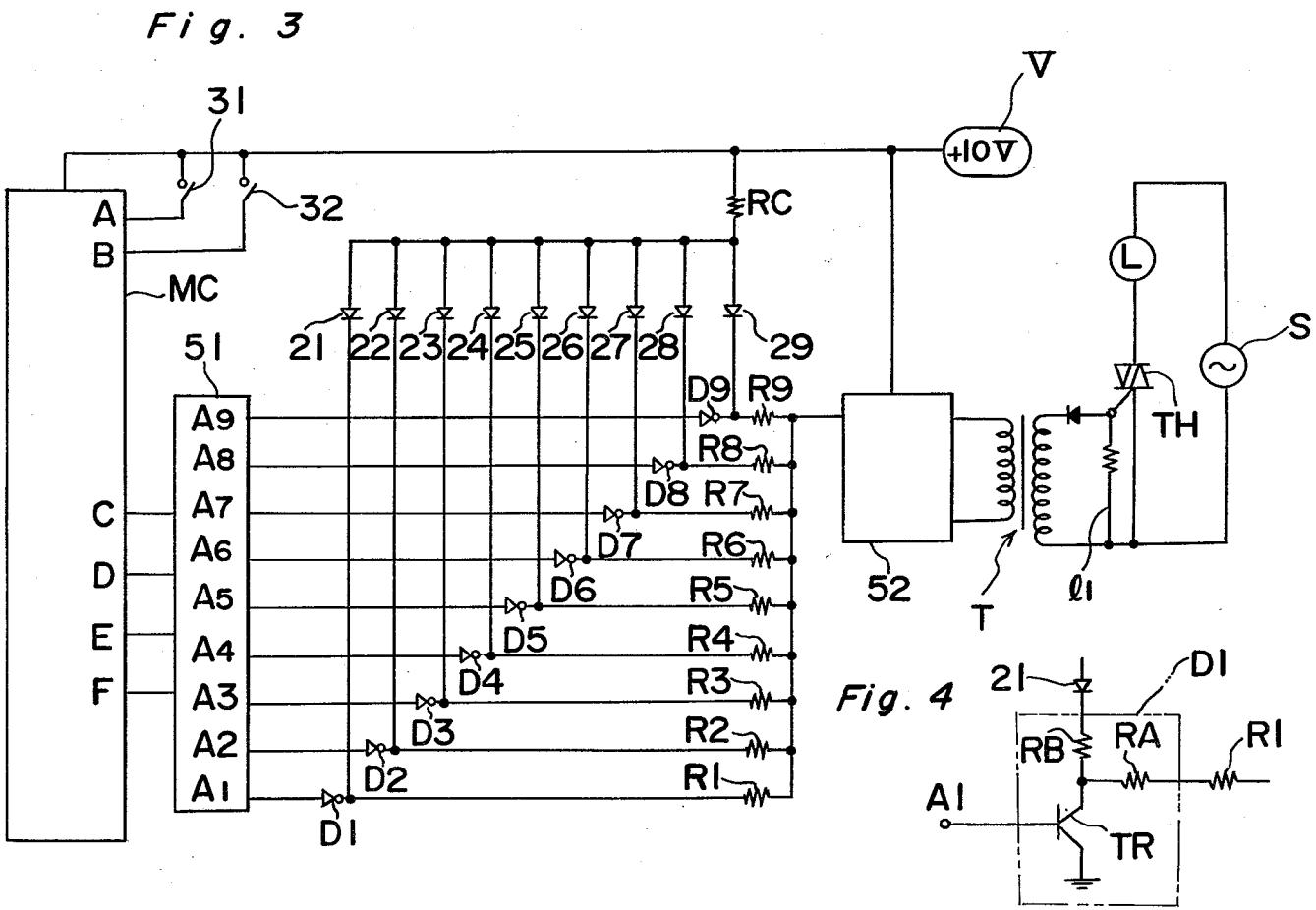
FIG. 3 is an electrical circuit diagram showing a microcomputer and an exposure lamp connected thereto which are employed in the electrophotographic copying apparatus of FIG. 1.
FIG. 4 is an electrical circuit diagram typically showing one of driver circuits employed in the electrical circuit of FIG. 3, FIGS. 5(*a*) and 5(*b*) are flow charts showing processing sequences of operational control of amount of exposure by the microcomputer of FIG. 3, FIGS. 6(*a*) and 6(*b*) are flow charts similar to FIG. 5(*a*), particularly showing a modification thereof, and FIGS. 7(*a*) and 7(*b*) are flow charts for image magnification similar to FIGS. 5(*a*) and 5(*b*), which are modifications thereof, respectively.

Referring now to FIG. 3, there is shown a control circuit in which the exposure amount display lamps 21 to 29 and an exposure lamp L are controlled by a control device through the use of a microcomputer MC. The control circuit includes a first circuit portion for controlling the exposure amount indicator 20 and a second circuit portion for controlling the exposure lamp L. The first circuit portion and the second circuit portion are coupled by a transformer T.

The first circuit portion further includes the UP switch 31, DOWN switch 32, a DC power source V, a decimal converter 51 for binary digit to decimal digit conversion, driver circuits D1, D2, D3, D4, D5, D6, D7, D8 and D9, resistors R1, R2, R3, R4, R5, R6, R7, R8 and R9. The microcomputer MC includes input ports A and B, and output ports C, D, E and F. The DC power source V is connected to the microcomputer MC, to the input port A through the normally open UP switch 31, to the input port B through the normally open DOWN switch 32 and to the oscillator 52. The output ports C, D, E and F are connected to the decimal converter 51. Nine output terminals A1, A2, A3, A4, A5, A6, A7, A8 and A9 of the decimal converter 51 are connected, through driver circuits D1 to D9, respectively, to resistors R1 to R9, which respectively, lead to the oscillator 52. The driver circuits D1 to D9 also, respectively, lead to display lamps 21 to 29 which are formed with light emitting diodes. The display lamps 21 to 29 are joined together and their junctions are, in turn, connected to the DC power source V through a resistor RC.

More specifically, the driver circuit D1 comprises a transistor TR, resistors RA and RB as shown in FIG. 4. The output terminal A1 of the decimal converter 51 is connected to the base of the transistor. The emitter of the transistor TR is grounded. The collector of the transistor TR is connected to the display lamp 21 by way of the resistor RB and also leads to the resistor R1 via the resistor RA.

Since other driver circuits D2 to D9 have the same arrangement as the above-described driver circuit D1, detailed description thereof is abbreviated here for brevity.

The second circuit portion is designed in the conventional manner through the use of an AC power source S, the exposure lamp L and a triac TH. The AC power source S, exposure lamp L and triac TH are connected in series.

Meanwhile, the transformer T is connected to the oscillator 52 in the first circuit portion and to a line l1 leading to the gate terminal of the triac TH in the second circuit portion.

As is clear from the foregoing description, the oscillator 52 is so arranged as to generate trigger pulses for the triac TH which performs phase control of the exposure lamp L. The trigger pulses are generated in response to a phase corresponding to each resistance value of resistors R1 to R9, so that light quantity of the exposure lamp L is changed in response to corresponding indication of display lamps 21 to 29.

Processing sequences of one operational control of amount of exposure in the mechanical arrangement shown in FIGS. 3 and 4 will be described hereinbelow with reference to flow charts shown in FIGS. 5(*a*) and 5(*b*).

Figure 5A:
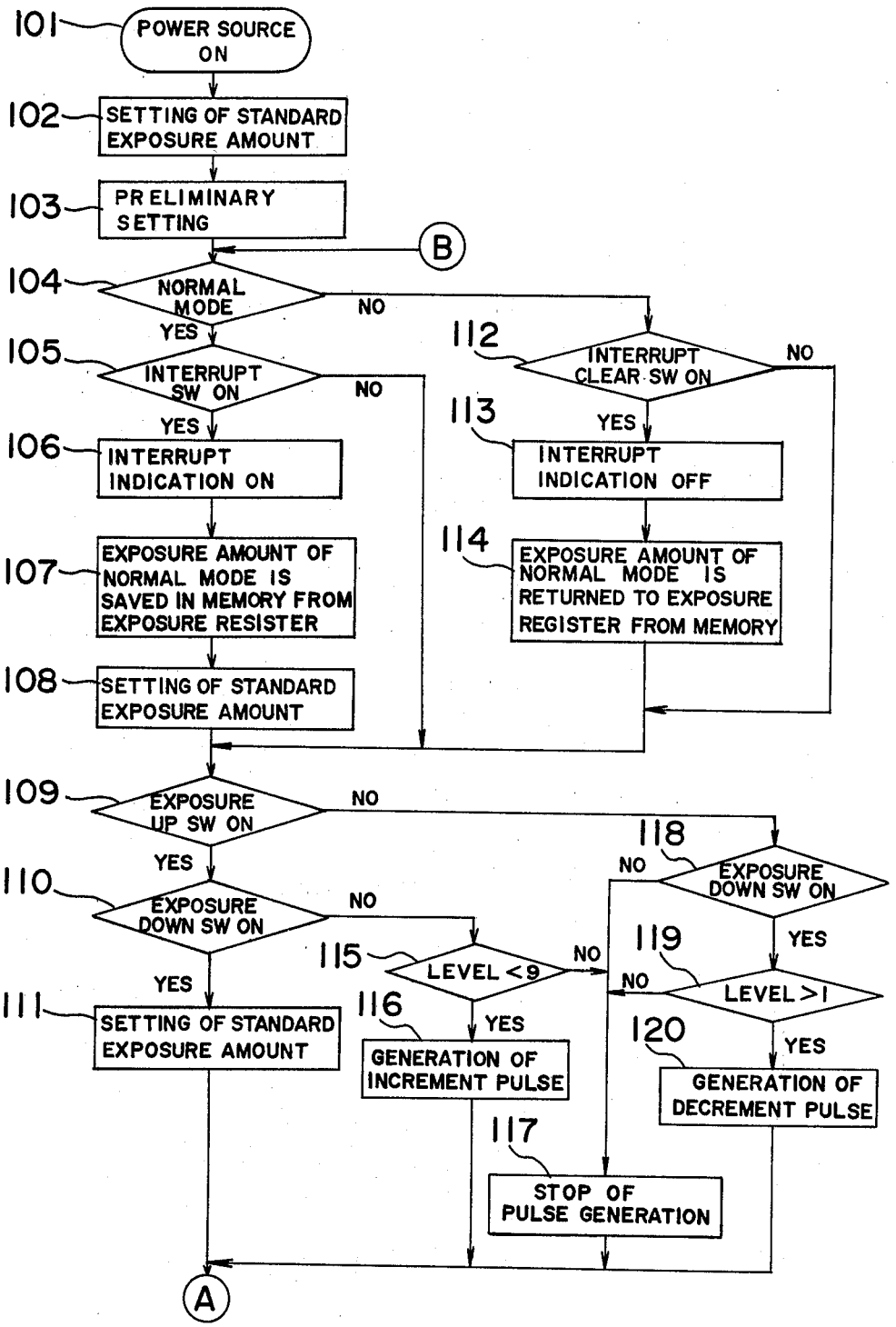
Figure 5B:
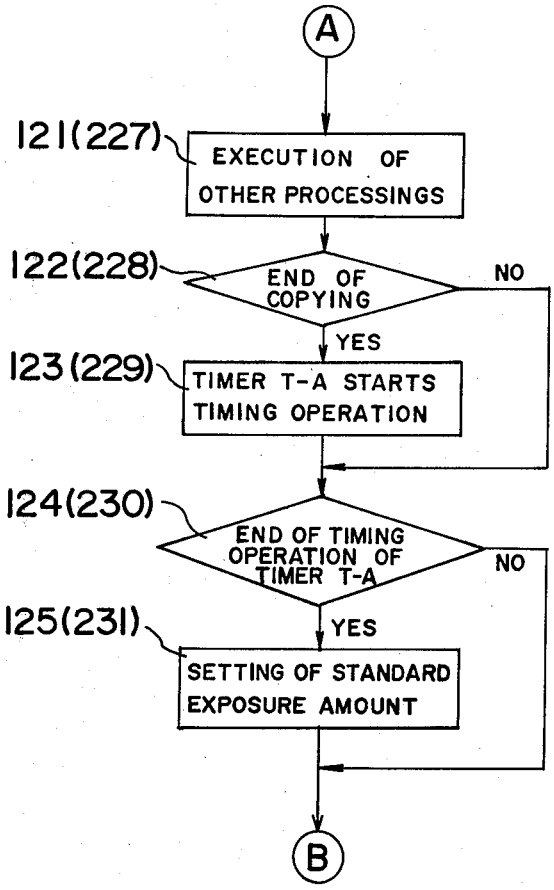

As shown in FIG. 5(*a*), when a power source switch (not shown) is turned on at a step 101, the display lamp 25 is turned on through output ports C to F of the microcomputer MC and, at the same time, a signal is produced at the terminal A5 of the decimal converter 51 so as to turn on the driver circuit A5, whereby the exposure lamp L is set to a standard amount of exposure at a step 102.

At a step 103, other preliminary settings for copying such as selection of single copying, either one of upper and lower cassettes 4, etc. are performed.

At a step 104, a decision is made as to whether or not copying is performed in the normal copying mode. In the case of "YES", a step 105 follows so as to decide whether or not an interrupt key is depressed. In the case of "YES", an indication for the interrupt copying mode is turned on at a step 106, an amount of exposure set for the normal copying mode is saved from an exposure amount register to a memory in the microcomputer MC at a step 107, the exposure lamp L is set to the standard amount of exposure at a step 108, and a step 109 follows.

Meanwhile, in the case of "NO" at the step 105, the step 109 follows.

On the contrary, in the case of "NO" at the step 104, a decision is made as to whether or not an interrupt clear key is depressed at a step 112. In the case of "YES", the indication for the interrupt copying mode is turned off at a step 113, the amount of exposure set for the normal copying mode which was saved in the memory in the microcomputer MC at the time of interruption is returned to the exposure amount register from the memory at a step 114 and the step 109 follows.

Then, at the stop 109, a decision is made as to whether or not the exposure amount UP switch 31 is turned on for a short period of time, for example, for 50 msec. In the case of "YES", a decision is made as to whether or not the exposure amount DOWN switch 32 is turned on at a step 110. In the case of "YES", the exposure lamp L is set to the standard exposure amount at a step 111 and then, a step 121 in FIG. 5(*b*) follows.

Thus, when the UP switch 31 and the DOWN switch 32 are turned on at the same time, a level in the exposure amount register is set to 5 so as to turn on the output terminal A5 of the decimal converter 51, so that the driver circuit D5 is turned on and thus, the exposure lamp is set to the standard exposure amount with the display lamp 25 being turned on.

Meanwhile, in the case of "NO" at the step 110, a decision is made as to whether or not the level in the exposure amount register in the microcomputer MC is lower than 9 at a step 115. In the case of "YES", one increment pulse is generated so as to increase by one step the level in the exposure amount register, for example, from five to six at a step 116 and then, the step 121 in FIG. 5(*b*) follows.

Since the level 6 of the exposure amount register in the microcomputer MC is transmitted to the decimal converter 51, the output terminal A6 is set to "1" so as to turn on the driver circuit D6, so that the ignition phase of the triac TH is leading in comparison with that of the level 5 and thus, the exposure lamp L is illuminated at the exposure amount in response to the level 6 so as to perform copying at said exposure amount with the display lamp 26 being turned on.

Meanwhile, in the case of "NO" at the step 115, pulse generation is stopped at a step 117 and then, the step 121 in FIG. 5(*b*) follows.

On the contrary, in the case of "NO" at the step 109, a decision is made as to whether or not the exposure amount DOWN switch 32 is turned on at a step 118. In the case of "YES", a decision is made as to whether or not the level in the exposure amount register is higher than 1 at a step 119. In the case of "YES", one decrement pulse is generated so as to decrease by one step the level in the exposure amount register, for example, from five to four, at a step 120. In the same manner as the step 116, the level in the exposure amount register is set to 4 so as to turn on the output terminal A4 of the decimal converter 51, so that the exposure lamp L is illuminated at the exposure amount in response to the level 4 so as to perform copying at said exposure amount with the display lamp 24 being turned on.

In the case of "NO" either at the step 118 or at the step 119, the step 117 follows.

Then, other processings are executed at the step 121 as shown in FIG. 5(*b*) and a decision is made as to whether or not copying has been finished at a step 122. In the case of "YES", the microcomputer MC starts the timing operation of an internal automatic-reset timer T-A in the microcomputer MC at a step 123 and a decision is made as to whether or not the timing operation of the timer T-A has been finished at a step 124. In the case of "YES", the exposure lamp L is set to the standard exposure amount at a step 125 and then, the processing sequence is returned back to the step 104.

In the case of "NO" at the step 122, the step 124 follows.

In the case of "NO" at the step 124, the processing sequence is returned back to the step 104.

Meanwhile, it is so arranged that the exposure lamp L is reinstated to the standard exposure amount upon termination of the timing operation of the timer T-A after copying has been finished.

However, the timer T-A is so arranged as to start its timing operation when either one of the UP switch 31 and DOWN switch 32 is turned on even if copying has been finished. Namely, when an operation for changing the exposure amount is performed, the timer T-A starts its timing operation. When neither copying nor another operation for changing the exposure amount is performed during a setting time period of the timer, the exposure amount is reinstated to the standard value.

Figure 6A:
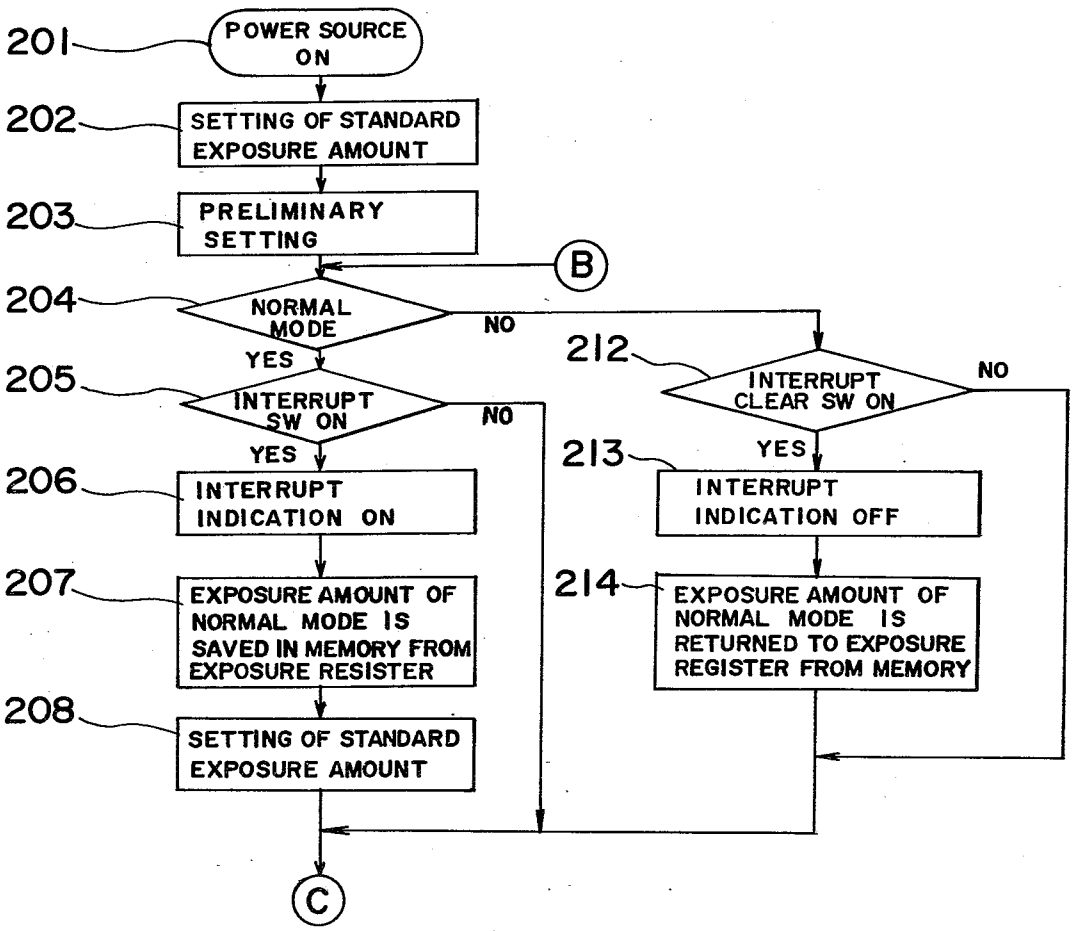
Figure 6B:
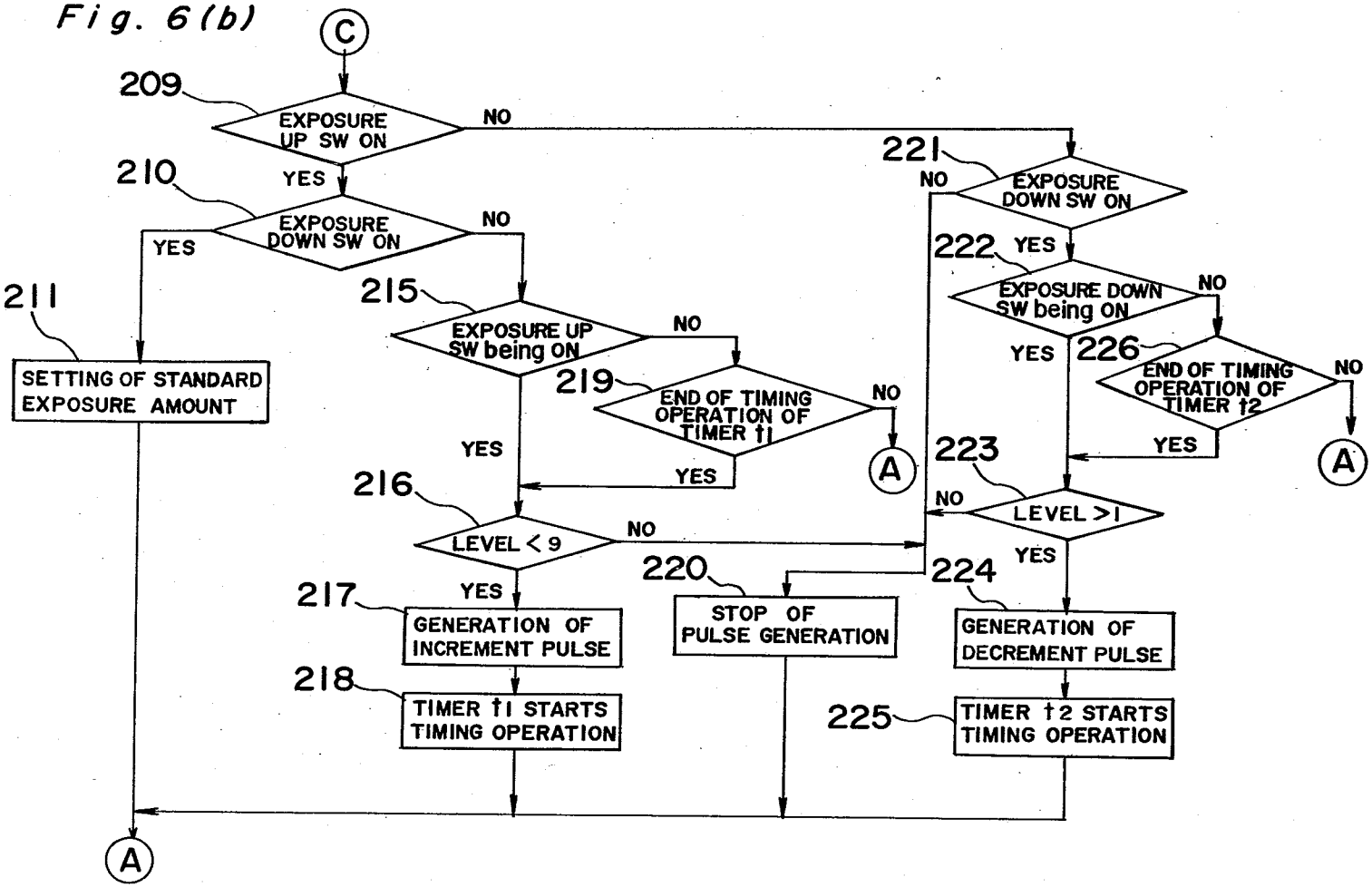

However, it can be so arranged alternatively that the microcomputer MC is provided with a timer t1 and a timer t2 for the UP switch 31 and DOWN switch 32, respectively, so that the exposure amount level can be changed sequentially and continuously in case either one of the UP switch 31 and DOWN switch 32 is being turned on when either one of the timers t1 and t2 has finished timing operation as shown in FIGS. 6(*a*) and 6(*b*) which are a modification of FIG. 5(*a*).

Referring to FIGS. 6(*a*) and 6(*b*), steps 201 to 208 and steps 212 and 214 are the same as steps 101 to 108 and steps 112 to 114 in FIG. 5(*a*), respectively, and thus, detailed description thereof is abbreviated here for brevity.

At a step 209, a decision is made as to whether or not the UP switch 31 is turned on. In the case of "YES", a decision is made as to whether or not the DOWN switch 32 is turned on at a step 210. In the case of "YES", the exposure lamp L is set to the standard exposure amount at a step 211 and then, a step 227 given in parentheses in FIG. 5(*a*) follows.

Meanwhile, in the case of "NO" at the step 210, a decision is made as to whether or not the UP switch 31 is being turned on at a step 215. In the case of "YES", a decision is made as to whether or not the level in the exposure amount register in the microcomputer MC is lower than 9 at a step 216. In the case of "YES", one increment pulse is generated at a step 217, the timer t1 starts its timing operation at a step 218 and then, the step 227 in FIG. 5(*b*) follows.

In the case of "NO" at the step 216, pulse generation is stopped at a step 220 and then, the step 227 in FIG. 5(*b*) follows.

In the case of "NO" at the step 215, a decision is made as to whether or not the timer t1 has finished its timing operation at a step 219. In the case of "YES", the step 216 follows. In the case of "NO" at the step 219, the step 227 in FIG. 5(*b*) follows.

On the contrary, in the case of "NO" at the step 209, a decision is made as to whether or not the DOWN switch 32 is turned on at a step 221. In the case of "YES", a decision is made as to whether or not the DOWN switch 32 is being turned on at a step 222. In the case of "YES", a decision is made as to whether or not the level in the exposure amount register in the microcomputer MC is higher than 1 at a step 223. In the case of "YES", one decrement pulse is generated at a step 224, the timer t2 starts its timing operation at a step 225 and then, the step 227 in FIG. 5(*b*) follows.

In the case of "NO" at the step 222, a decision is made as to whether or not the timer t2 has finished its timing operation at a step 226. In the case of "YES" and "NO", the step 223 and the step 226 in FIG. 5(*b*) follow, respectively.

In the case of "NO" either at the step 221 or at the step 223, the step 220 follows.

Meanwhile, the step 227 is followed by steps 228 to 231 which are also given in parentheses in FIG. 5(*b*) and then, the processing sequence is returned to the step 204. Since steps 227 to 231 are the same as steps 121 to 125 in FIG. 5(*b*), respectively, detailed description thereof is abbreviated here for brevity.

Meanwhile, the timers t1 and t2 are so arranged as to start the timing operation upon termination of timing operation of the timers t1 and t2 or when the UP switch 31 or the DOWN switch 32 are turned on.

Furthermore, when the UP switch 31 and DOWN switch 32 are turned on simultaneously, processing in response to termination of the timing operation of the timers t1 and t2 is substantially cancelled and thus, the step 111 in FIG. 5(*a*) and the step 211 in FIG. 6(*b*) are executed.

Moreover, when the UP switch 31 and DOWN switch 32 are turned on several times intermittently even during the setting time period of the timers t1 and t2, the timers t1 and t2 are reset through turning off of the UP switch 31 and the DOWN switch 32, respectively, so that the level in the exposure amount register is increased and decreased by the number of operational times of the UP switch 31 and DOWN switch 32, respectively.

Moreover, referring again to flow charts shown in FIGS. 5(*a*), 5(*b*), 6(*a*) and 6(*b*), the exposure lamp L is set to the standard exposure amount when the UP switch 31 and DOWN switch 32 are turned on at the same time. However, even if either one of the UP switch 31 and DOWN switch 32 is turned off with the UP switch 31 and DOWN switch 32 being turned on simultaneously, neither increment nor decrement pulse is generated, so that the exposure lamp L is still set to the standard exposure amount.

It is needless to say that the exposure lamp L is set to the standard exposure amount when either one of the UP switch 31 and DOWN switch 32 is turned on with the other one of the UP switch 31 and DOWN switch 32 being turned on.

Such operational characteristics are so arranged as to eliminate the disadvantage that unexpected or undesirable operations are performed due to time gap between turning on or turning off of the UP switch 31 and the DOWN switch 32 because it is actually impossible for the operator to turn on or turn off two switches simultaneously at a level of throughput of microcomputers.

In the embodiment described above, although the standard exposure amount is described as set to the display lamp 25 of the indicator 20, this may be so modified as to be set to another display lamp in frequent use, alternatively.

Meanwhile, the step 108 in FIG. 5(*a*) and the step 208 in FIG. 6(*a*) may be deleted so that the exposure amount in the normal mode at the time of interruption is continuously used thereafter.

In accordance with the present invention, the exposure amount can be set to any value or reinstated to the standard value by a push-button operation, so that the exposure amount may be indicated by one of display lamps which is turned on and thus, the confirmation and determination of the exposure amount are made far easier as compared with conventional lever operations, whereby erroneous copying due to improper exposure amount can be positively prevented.

Moreover, the present invention may be applied not only to electrophotographic copying apparatuses including operational devices for setting the number of copies to be taken or the image magnification, but also to various kinds of mechanical arrangements including operational devices for setting controlled devices to any desirable values.

Figure 7:
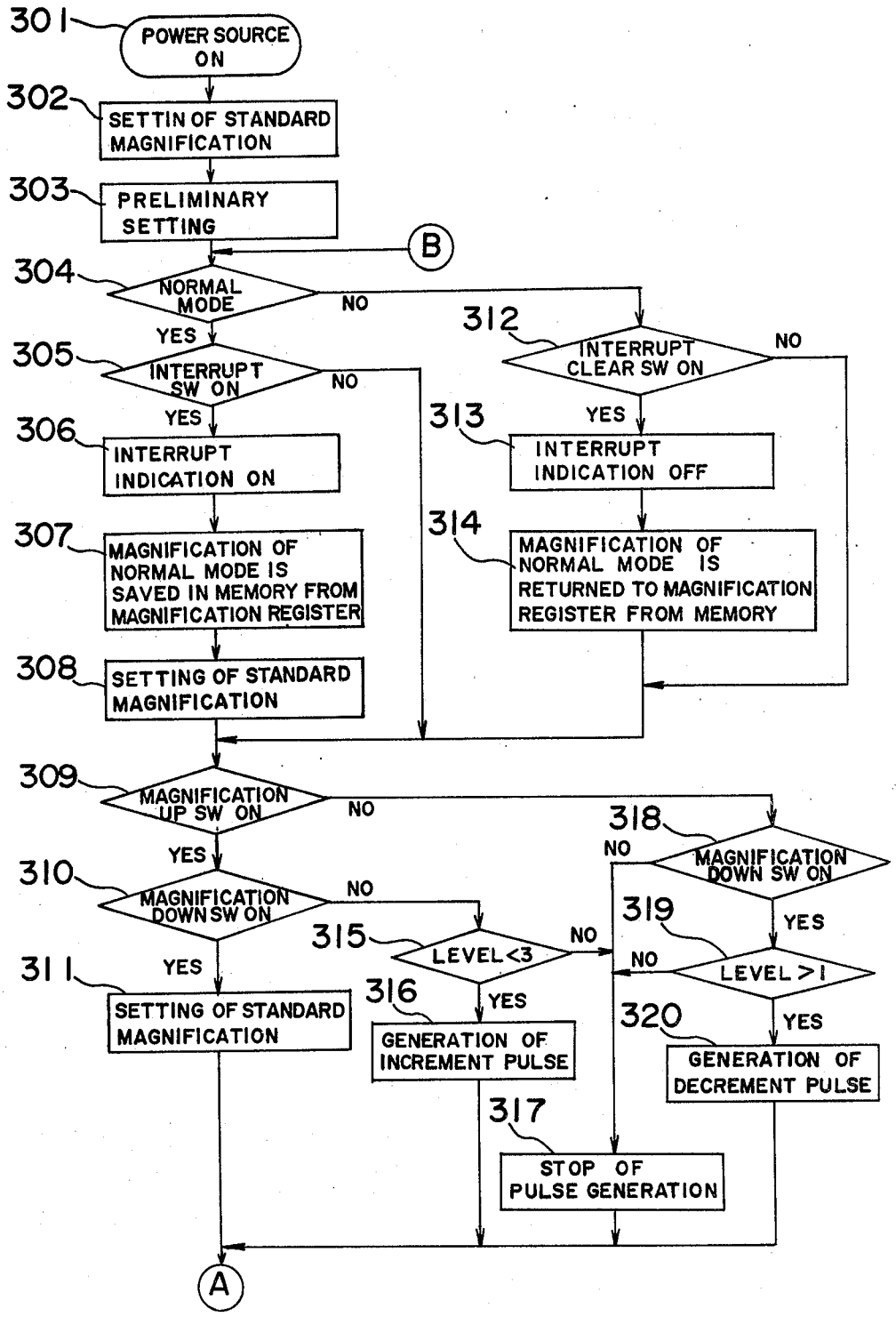
Figure 7B:
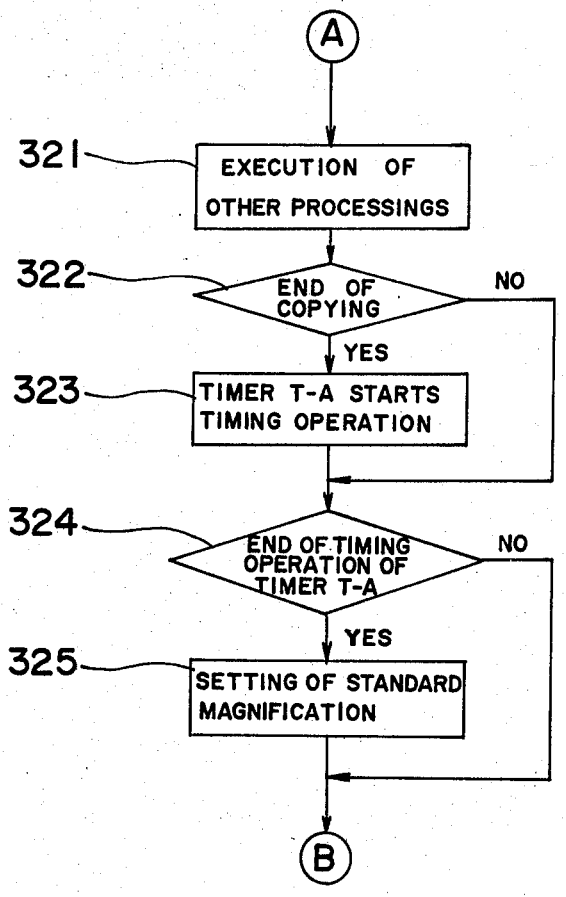

Referring further to FIGS.7(*a*) and 7(*b*), there are shown flow charts for setting the image magnification of electrophotographic copying apparatuses.

Since the processing sequences of FIGS. 7(*a*) and 7(*b*) are generally similar to those of FIGS. 5(*a*) and 5(*b*), detailed description thereof is abbreviated here for brevity.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A mechanical arrangement including a device to be controlled, an operational device for adjusting an active state of said controlled device through external operations and a control means for controlling the active state of said controlled device in response to operations of said operational device, said operational device comprising:

indicating means for indicating changes in the active state of said controlled device stepwise;

UP operating means for increasing one step by one step an indication of said indicating means; and DOWN operating means for decreasing one step by one step the indication of said indicating means;

said control means comprising:

means for changing the indication of said indicating means in response to operations of said UP operating means and said DOWN operating means and for changing the active state of said controlled device in accordance with the indication of said indicating means; and means for setting the indication of said indicating means and the active state of said controlled device to a predetermined standard value when said UP operating means and said DOWN operating means are operated simultaneously.

2. A mechanical arrangement as claimed in claim 1, wherein said UP operating means and said DOWN operating means comprise automatic-reset UP and DOWN switching elements, respectively, said UP and DOWN switching elements being so arranged as to be closed and opened when depressed and not depressed, respectively, said control means increasing or decreasing by one step the indication of said indicating means every time either one of said UP and DOWN switching elements is closed once.

3. A mechanical arrangement as claimed in claim 2, wherein said control means further includes UP and DOWN timer elements for said UP and DOWN switching elements, respectively, said UP and DOWN timer elements being so arranged as to start the timing operation upon change in the indication of said indicating means, said control means changing by one step the indication of said indicating means upon termination of the timing operation of either one of said UP and DOWN timer elements in case either one of said UP and DOWN switching elements is being closed when either one of said UP and DOWN timer elements has finished the timing operation.

4. A mechanical arrangement as claimed in claim 2 or claim 3, wherein said control means causes said indicating means to maintain the indication even if either one of said UP and DOWN switching elements is opened when said UP and DOWN switching elements have been closed simultaneously so as to reinstate the indication of said indicating means to the standard value.

5. A mechanical arrangement as claimed in claim 1, wherein said controlled device is a lamp, said indicating means indicate light quantity of said lamp by at least three gradual steps, and said control means has the function of associating at least the indication of said indicating means with light quantity of said lamp.

6. A copying apparatus including an exposure lamp, an operational device for adjusting light quantity of said exposure lamp through external operations and a control means for controlling the light quantity of said exposure lamp in response to operations of said operational device, said operational device comprising:

indicating means for indicating changes in the light quantity of said exposure lamp stepwise;

UP operating means for increasing one step by one step the indication of said indicating means; and DOWN operating means for decreasing one step by one step the indication of said indicating means;

said control means comprising:

means for changing the indication of said indicating means in response to operations of said UP operating means and said DOWN operating means and for changing the light quantity of said exposure lamp in accordance with the indication of said indicating means; and means for setting the indication of said indicating means and the light quantity of said exposure lamp to a predetermined standard value when said UP operating means and said DOWN operating means are operated simultaneously.

7. A copying apparatus as claimed in claim 6, wherein said UP operating means and said DOWN operating means comprise automatic-reset UP and DOWN switching elements, respectively, said UP and DOWN switching elements being so arranged as to be closed and opened when depressed and not depressed, respectively, said control means increasing or decreasing by one step the indication of said indicating means every time either one of said UP and DOWN switching elements is closed once.

8. A copying apparatus as claimed in claim 7, wherein said control means further includes UP and DOWN timer elements for said UP and DOWN switching elements, respectively, said UP and DOWN timer elements being so arranged as to start the timing operating upon change in the indication of said indicating means, said control means changing by one step the indication of said indicating means upon termination of the timing operation of either one of said UP and DOWN timer elements in case either one of said UP and DOWN switching elements is being closed when either one of said UP and DOWN timer elements has finished the timing operation.

9. A copying apparatus as claimed in claim 7 or claim 8, wherein said control means causes said indicating means to maintain the indication even if either one of said UP and DOWN switching elements is opened when said UP and DOWN switching elements have been closed simultaneously so as to reinstate the indication of said indicating means to the standard value.

10. A copying apparatus as claimed in claim 6, further having the function of interrupt copying so as to perform another copying mode by interrupting normal copying mode, said control means further storing in a memory the indication of said indicating means which was indicated during the normal copying mode and setting the indication of said indicating means to the standard value, when the interruption is performed.

11. A copying apparatus as claimed in claim 10, wherein said control device reinstates the indication of said indicating means to the indication which was indicated during the normal copying mode and which was stored in the memory, when the interrupt copying mode is cleared.

12. A copying apparatus including a device to be controlled, an operational device for adjusting an active state of said controlled device through external operations and a control means for controlling the active state of said controlled device in response to operations of said operational device, said operational device comprising:

indicating means for indicating changes in the active state of said controlled device stepwise;

UP operating means for increasing one step by one step an indication of said indicating means; and DOWN operating means for decreasing one step by one step the indication of said indicating means;

said control means comprising:

means for changing the indication of said indicating means in response to operations of said UP operating means and said DOWN operating means and for changing the active state of said controlled device in accordance with the indication of said indicating means; and means for setting the indication of said indicating means and the active state of said controlled device to a predetermined standard value when said UP operating means and said DOWN operating means are operated simultaneously.

13. A copying apparatus as claimed in claim 12, wherein said controlled device is an image magnification changing device for changing the magnification of the image to be formed.

14. A copying apparatus as claimed in claim 13, wherein said UP operating means and said DOWN operating means comprise automatic-reset UP and DOWN switching elements, respectively, said UP and DOWN switching elements being so arranged as to be closed and opened when depressed and not depressed, respectively, said control means increasing or decreasing by one step the indication of said indicating means every time either one of said UP and DOWN switching elements is closed once.

15. A copying apparatus as claimed in claim 14, wherein said control means further includes UP and DOWN timer elements for said UP and DOWN switching elements, respectively, said UP and DOWN timer elements being so arranged as to start the timing operation upon change in the indication of said indicating means, said control means changing by one step the indication of said indicating means upon termination of the timing operation of either one of said UP and DOWN timer elements in case either one of said UP and DOWN switching elements is being closed when either one of said UP and DOWN timer elements has finished the timing operation.

16. A copying apparatus as claimed in claim 14 or claim 15, wherein said control means causes said indicating means to maintain the indication even if either one of said UP and DOWN switching elements is opened when said UP and DOWN switching elements have been closed simultaneously so as to reinstate the indication of said indicating means to the standard value.

17. A copying apparatus as claimed in claim 13, further having the function of interrupt copying so as to perform another copying by interrupting normal copying mode, said control means further storing in a memory the indication of said indicating means which was indicated during the normal copying mode and setting the indication of said indicating means to the standard value, when the interruption is performed.

18. A copying apparatus as claimed in claim 17, wherein said control means reinstates the indication of said indicating means to the indication which was indicated during the normal copying mode and which was stored in the memory, when the interrupt copying mode is cleared.

* * * * *